US012339035B1

(12) United States Patent
Li

(10) Patent No.: US 12,339,035 B1
(45) Date of Patent: Jun. 24, 2025

(54) MULTIFUNCTIONAL OUTDOOR FAN

(71) Applicant: Fang Li, Shenzhen Guangdong (CN)

(72) Inventor: Fang Li, Shenzhen Guangdong (CN)

( * ) Notice: Subject to any disclaimer, the term of this patent is extended or adjusted under 35 U.S.C. 154(b) by 0 days.

(21) Appl. No.: 19/041,966

(22) Filed: Jan. 30, 2025

(51) Int. Cl.

| | |
|---|---|
| ***F24F 6/12*** | (2006.01) |
| ***F04D 19/00*** | (2006.01) |
| ***F04D 29/52*** | (2006.01) |
| ***F24F 6/00*** | (2006.01) |

(52) U.S. Cl.
CPC ..... *F24F 6/12* (2013.01); *F04D 19/002* (2013.01); *F04D 29/522* (2013.01); *F24F 2006/008* (2013.01); *F24F 2221/12* (2013.01)

(58) Field of Classification Search
CPC ..... F24F 6/12; F24F 2006/008
See application file for complete search history.

(56) References Cited

U.S. PATENT DOCUMENTS

| | | | | |
|---|---|---|---|---|
| 2011/0036926 | A1* | 2/2011 | Nunes | F24F 6/12 239/214 |
| 2021/0293425 | A1* | 9/2021 | Ma | F24F 6/12 |
| 2021/0310718 | A1* | 10/2021 | Zeng | F25D 7/00 |
| 2022/0080437 | A1* | 3/2022 | Zhong | F04D 25/0673 |
| 2022/0099316 | A1* | 3/2022 | Zou | F24F 6/14 |

* cited by examiner

*Primary Examiner* — Lionel Nouketcha
(74) *Attorney, Agent, or Firm* — Allen J. Oh

(57) ABSTRACT

Disclosed is a multifunctional outdoor fan, including a mounting housing, and an installation area formed in a middle of the mounting housing; a water tank is arranged on an upper part of the mounting housing, an atomization unit is arranged inside the water tank, and water in the water tank is atomized and discharged by the atomization unit; a fan body is arranged in the installation area, at least one part of the fan body is hinged to a side wall of the installation area, and the fan body can rotate relative to the installation area to adjust an airflow direction; a rotating device is arranged at a lower part of the mounting housing for driving the mounting housing to rotate; and a base is connected to the rotating device and is provided with a control panel for controlling an operating state.

6 Claims, 7 Drawing Sheets

MULTIFUNCTIONAL OUTDOOR FAN

TECHNICAL FIELD

The present disclosure pertains to the technical field of fans, and particularly relates to a multifunctional outdoor fan.

BACKGROUND

With the increasing popularity of outdoor activities, people have raised more rigorous requirements for the functionality and portability of outdoor equipment. Traditional outdoor fans mainly focus on a single function, that is, air blowing. However, in hot outdoor environments, simple air blowing is often unable to meet people's needs for cooling and increasing comfort. Especially in dry climates, people also desire humidified air to alleviate dryness and discomfort of skin.

Therefore, it is necessary to make improvements in this regard.

SUMMARY

In order to overcome the defects in the prior art and the technical problems in the background, the present disclosure provides a multifunctional outdoor fan.

In order to solve the above technical problems, the present disclosure adopts the following technical solution: a multifunctional outdoor fan, including a mounting housing, a hollow installation area is formed in a middle of the mounting housing, a water tank is arranged on an upper part of the mounting housing, one or more atomization units are arranged inside the water tank, the atomization units are exposed on the mounting housing, and water in the water tank is driven by the atomization units to be atomized and discharged; the multifunctional outdoor fan further includes a fan body, a rotating device, and a base, where the fan body is arranged in the installation area, at least one part of the fan body is hinged to a side wall of the installation area, and the fan body can rotate relative to the installation area to adjust an airflow direction; the rotating device is arranged at a lower part of the mounting housing, and the rotating device is configured for driving the mounting housing to rotate; and the base is connected to the rotating device, and the base is further provided with a control panel for controlling an operating state of the multifunctional outdoor fan.

Further, the atomization unit is an ultrasonic atomizer.

Further, the fan body includes a fan housing, a first motor arranged inside the fan housing, and a fan blade arranged on the first motor.

Further, two sides of the fan body are respectively hinged to side walls of the installation area.

The rotating device includes a second motor, a bearing, a fixing shroud, and a limiting shaft; the lower part of the mounting housing is provided with an outwardly protruding ring portion, the second motor is installed at the lower part of the mounting housing, and an output end of the second motor extends along a center of the protruding ring portion; the bearing is sleeved onto the protruding ring portion; the fixing shroud is installed inside the base, and the fixing shroud connects the base to the mounting housing through screws; the limiting shaft is fixedly arranged inside the base, the limiting shaft is connected to the output end of the second motor; and the second motor drives the mounting housing to rotate relative to the base.

Further, the base includes a concave step that matches the protruding ring portion for rotation.

Further, a limiting notch is formed in a position of the protruding ring portion to limit a rotation range, and a convex point that matches the limiting notch is formed in a position of the concave step.

Further, the multifunctional outdoor fan also includes a charging interface, and the charging interface is arranged on the base.

Further, the multifunctional outdoor fan also includes a threaded opening, and the threaded opening is arranged at a bottom of the base.

Compared with the prior art, the present disclosure has the following beneficial effects:

improvement in user experience and comfort: the multifunctional outdoor fan integrates atomization and fan functions, with water in the water tank being atomized and discharged by the atomization units to effectively increase air humidity, such that a more comfortable environment is provided for the user, thereby making the outdoor fan especially suitable for dry or hot outdoor environments.

Flexible adjustment of airflow direction: the fan body is hinged to the side wall of the mounting area, such that the fan body can rotate relative to the mounting area to adjust the airflow direction, the user's needs for airflow at different positions and angles can be satisfied, improving the flexibility and convenience in use.

All-around rotation function: setting of the rotating device enables the entire mounting housing to rotate relative to the base, such that the airflow range is further expanded, and an overall use effect of the fan is improved.

Efficient atomization technology: the ultrasonic atomizer is used as the atomization unit, which features high atomization efficiency, low noise, and low energy consumption, ensuring stable and durable atomization performance, and improving the overall product performance.

Stable structure and easy maintenance: composed of the second motor, bearing, fixing shroud, and limiting shaft, the rotating device ensures the stability and safety of the mounting housing during rotation. Furthermore, the design also facilitates subsequent maintenance and repairing.

Figure 1:
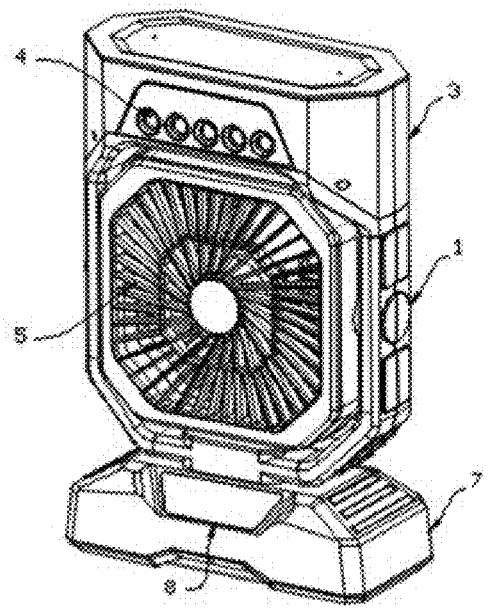
FIG. 1 is one structural schematic diagram according to the present disclosure.
Figure 2:
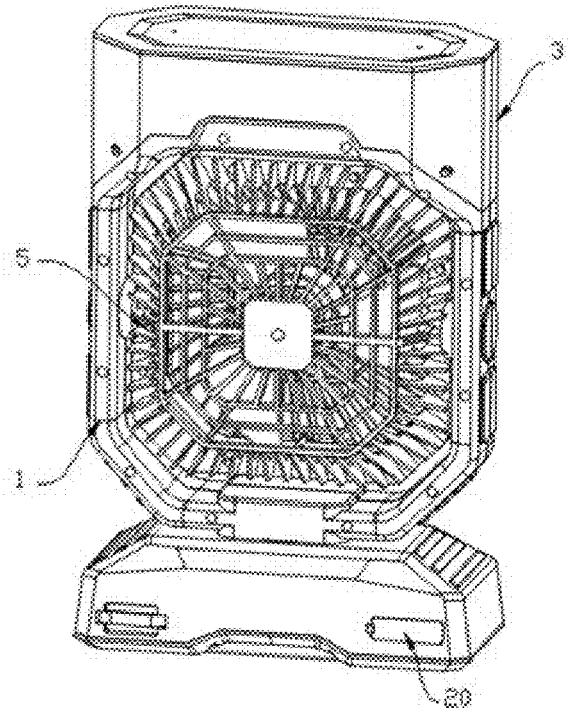
FIG. 2 is a structural schematic diagram of FIG. 1 from another angle.
Figure 3:
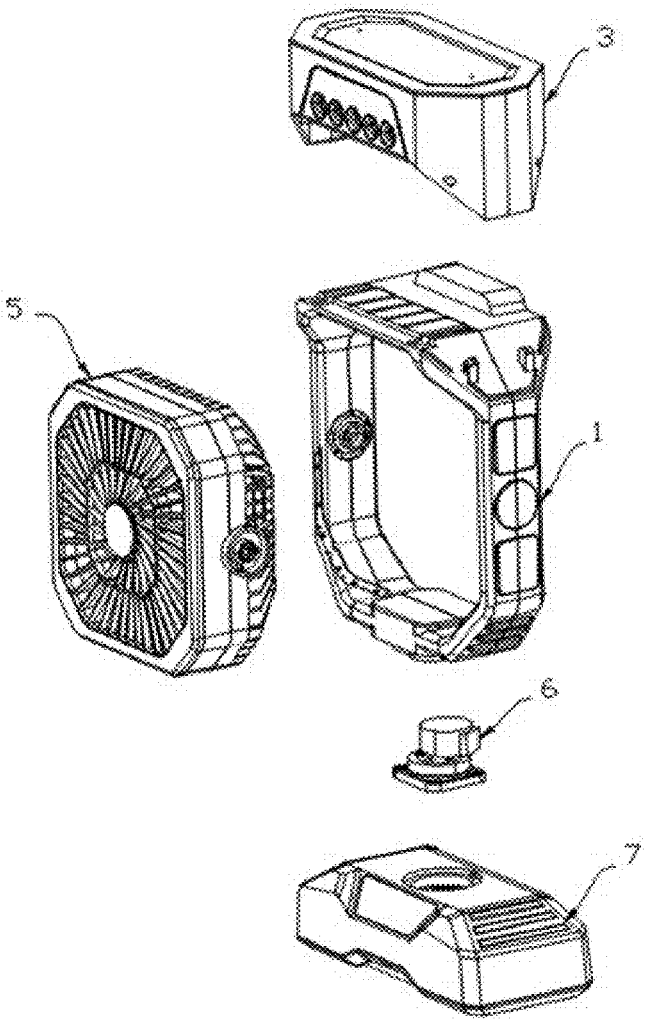
FIG. 3 is a schematic diagram of an exploded structure according to the present disclosure.
Figure 4:
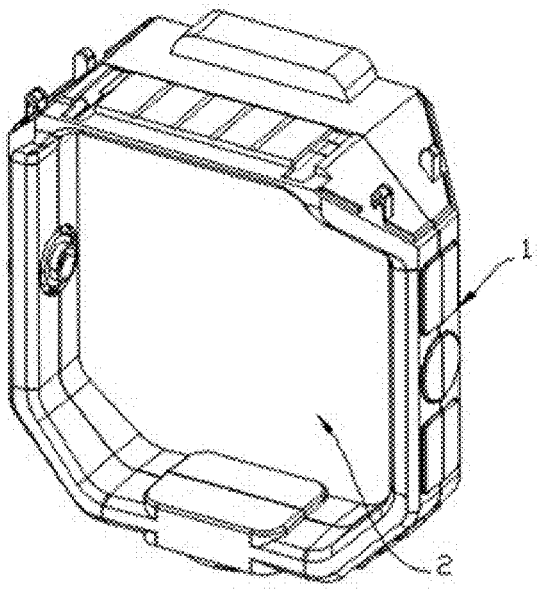
FIG. 4 is one structural schematic diagram of a mounting housing according to the present disclosure.
Figure 5:
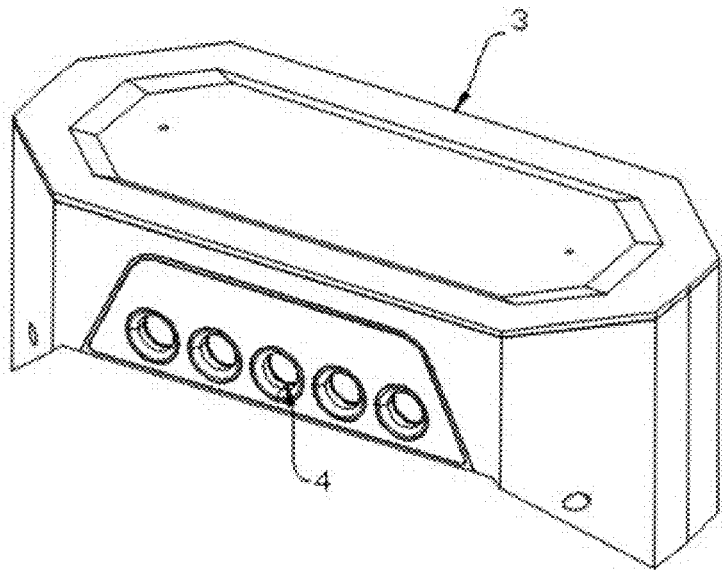
FIG. 5 is a structural schematic diagram of a water tank and an atomization unit according to the present disclosure.
Figure 6:
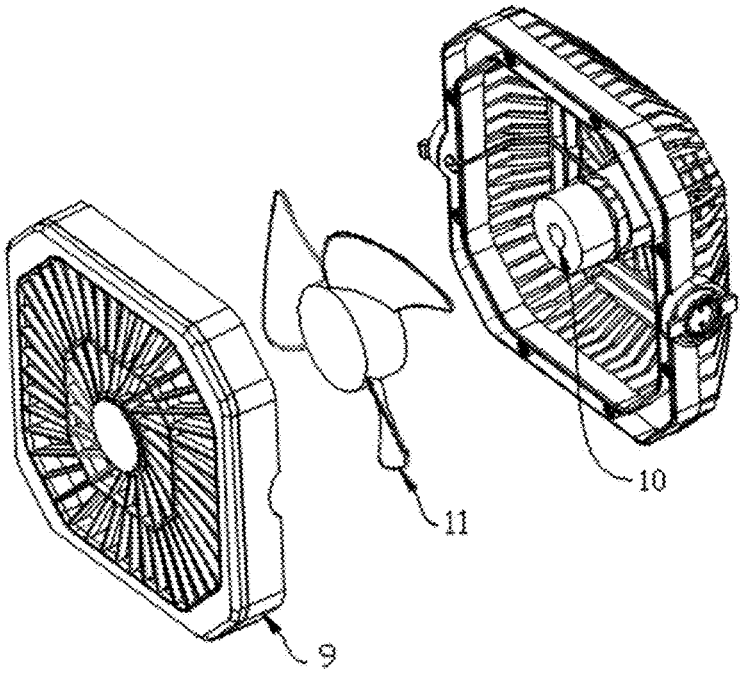
FIG. 6 is a structural schematic diagram of a fan body according to the present disclosure.
Figure 7:
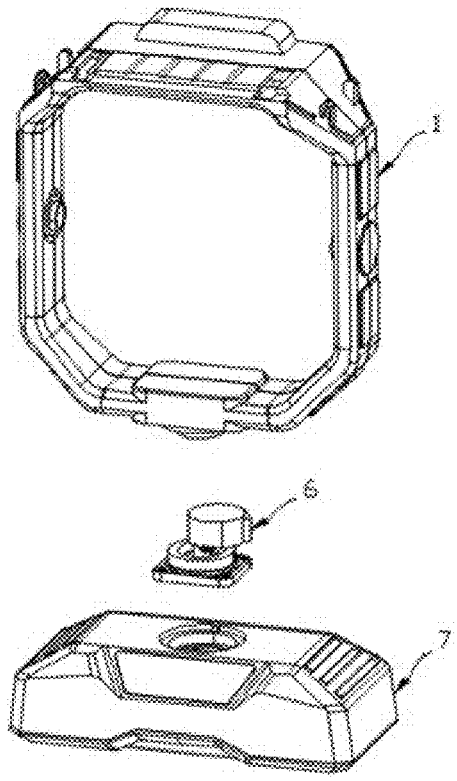
FIG. 7 is a structural schematic diagram of a mounting housing, a rotating device and a base according to the present disclosure.
Figure 8:
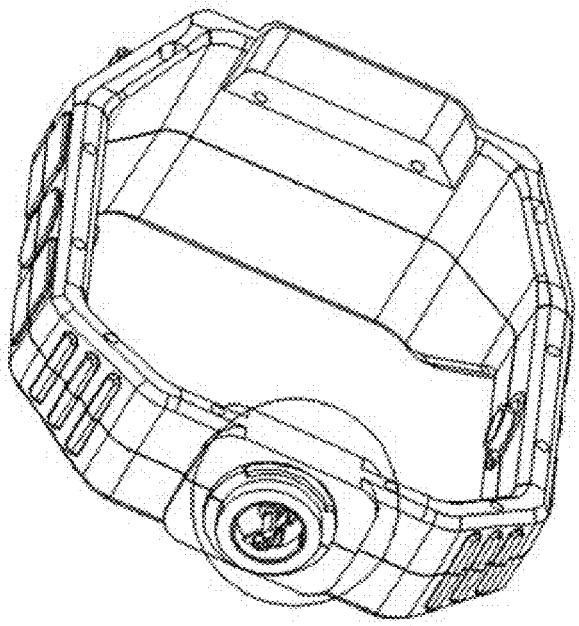
FIG. 8 is another structural schematic diagram of a mounting housing according to the present disclosure.
Figure 9:
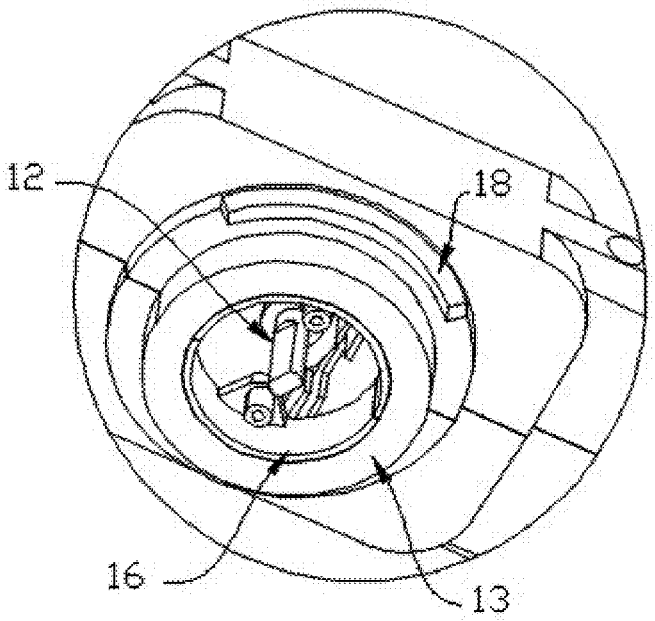
FIG. 9 is a partial enlarged structural schematic diagram of FIG. 8.
Figure 10:
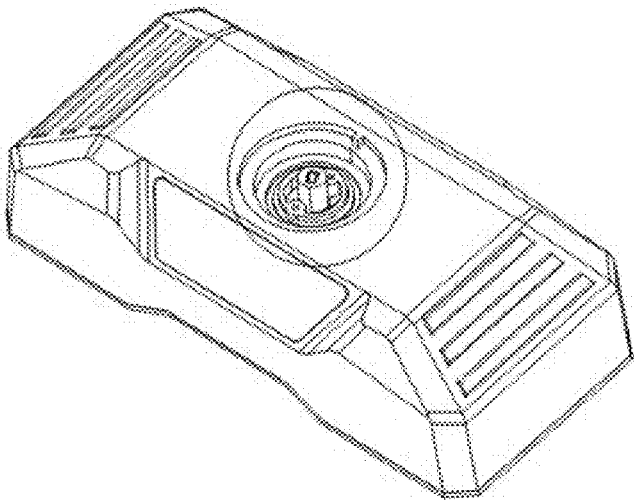
FIG. 10 is a structural schematic diagram of a base according to the present disclosure.
Figure 11:
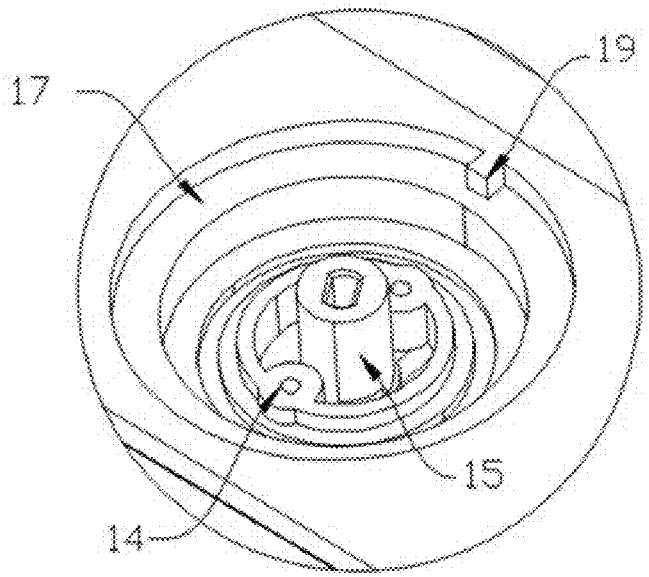
FIG. 11 is a partial enlarged structural schematic diagram of FIG. 10.
Figure 12:
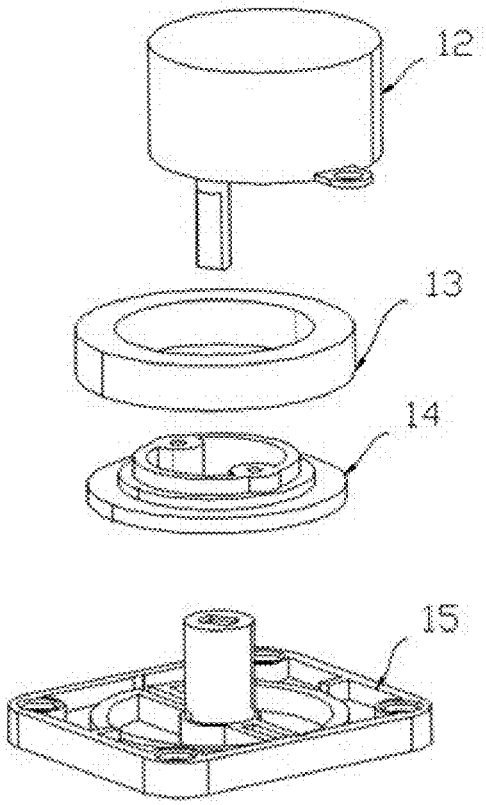
FIG. 12 is a schematic diagram of an exploded structure of a rotating device according to the present disclosure.
Figure 13:
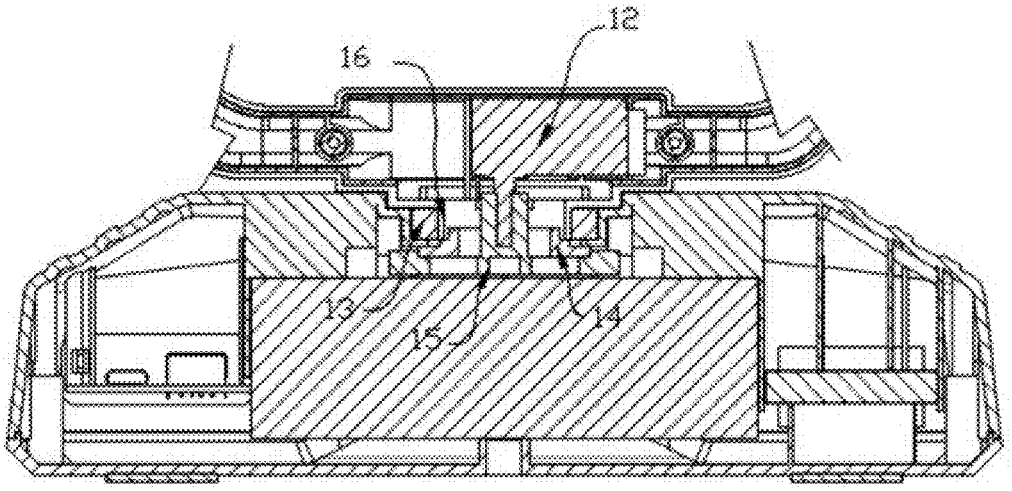
FIG. 13 is a structural schematic diagram of a partial sectional view according to the present disclosure.

Reference numerals in the accompanying drawings: 1. mounting housing; 2. installation area; 3. water tank; 4. atomization unit; 5. fan body; 6. rotating device; 7. base; 8. control panel; 9. fan housing; 10. first motor; 11. fan blade; 12. second motor; 13. bearing; 14. fixing shroud; 15. limiting shaft; 16. protruding ring portion; 17. concave step; 18. limiting notch; 19. convex point; 20. charging interface; 21. battery; and 22. threaded opening.

DETAILED DESCRIPTIONS OF THE EMBODIMENTS

The present disclosure will be further described in conjunction with the accompanying drawings and the embodiments.

In view of the technical problems described in the background, as shown in FIGS. 1-13, the present disclosure provides a multifunctional outdoor fan, including a mounting housing 1, a hollow installation area 2 is formed in a middle of the mounting housing 1, a water tank 3 is arranged on an upper part of the mounting housing 1, one or more atomization units 4 are arranged inside the water tank 3, the atomization units 4 are exposed on the mounting housing 1, and water in the water tank 3 is atomized and discharged by the atomization units 4; the multifunctional outdoor fan further includes a fan body 5, a rotating device 6, and a base 7, where the fan body 5 is arranged in the installation area 2, at least one part of the fan body 5 is hinged to a side wall of the installation area 2, and the fan body 5 can rotate relative to the installation area 2 to adjust an airflow direction; the rotating device 6 is arranged at a lower part of the mounting housing 1, and the rotating device 6 is configured for driving the mounting housing 1 to rotate; and the base 7 is connected to the rotating device 6, and the base 7 is further provided with a control panel 8 for controlling an operating state of the multifunctional outdoor fan.

The above multifunctional outdoor fan has a main structure as follows: the mounting housing 1, the water tank 3, the atomization unit 4, the fan body 5, the rotating device 6, the base 7, and the like.

First, the mounting housing 1 is used as a supporting structure of the entire fan, and the hollow installation area 2 is formed in a middle of the mounting housing for installing the fan body 5. The water tank 3 is arranged on an upper part of the mounting housing 1, the water tank 3 is configured for storing water; one or more atomization units 4 are arranged inside the water tank 3, and a number of the atomization units 4 is determined according to actual implementation; and in this embodiment, five atomization units 4 are preferably used, the atomization units 4 are exposed on the mounting housing 1, and are configured for atomizing the water in the water tank 3 and then discharging the atomized water to humid air.

The fan body 5 is arranged in the installation area 2, at least one part of the fan body is hinged to a side wall of the installation area 2. Preferably, in this embodiment, both sides of the fan body 5 are hinged to the side wall of the installation area 2, such that the fan body 5 can rotate relative to the installation area 2, and an airflow direction can be adjusted to meet a user's needs at various angles.

The rotating device 6 is arranged between the mounting housing 1 and the base 7 to realize the rotation of the mounting housing 1 relative to the base 7, thereby expanding an airflow range and meeting the user's needs.

Serving as a supporting foundation of the entire fan, the base 7 is connected to the rotating device 6, and is provided with a control panel 8 for controlling an operating state of the multifunctional outdoor fan. The control panel 8 is provided with various function buttons and indicator lights for easy operation and monitoring by the user.

In a specific implementation process, the user can adjust parameters such as fan speed, airflow direction, and atomization amount of the atomization units 4 via the control panel 8. In addition, since the fan body 5 is hinged to the installation area 2, the user can adjust an angle of the fan body 5 as needed to achieve an all-around airflow effect.

In an implementable technical solution, the atomization unit 4 is an ultrasonic atomizer. In this embodiment, the atomization unit 4 is designed and selected in a specific manner. Specifically, the present disclosure uses the ultrasonic atomizer as the atomization unit 4, a working principle of the ultrasonic atomizer is to atomize water molecules into fine mist droplets using high-frequency vibration, thereby achieving a humidification effect. The ultrasonic atomizer has the advantages of high atomization efficiency, low noise, and low energy consumption, making it suitable for the outdoor fan.

Specifically, the fan body 5 includes a fan housing 9, a first motor 10 arranged inside the fan housing 9, and a fan blade 11 arranged on the first motor 10.

As shown in FIGS. 8-13, the rotating device 6 includes a second motor 12, a bearing 13, a fixing shroud 14, and a limiting shaft 15; a lower part of the mounting housing 1 is provided with an outwardly protruding ring portion 16, the second motor 12 is installed at the lower part of the mounting housing 1, and an output end of the second motor 12 extends along a center of the protruding ring portion 16; the bearing 13 is sleeved onto the protruding ring portion 16; the fixing shroud 14 is installed inside the base 7, and the fixing shroud 14 connects the base 7 to the mounting housing 1 through screws; the limiting shaft 15 is fixedly arranged inside the base 7, the limiting shaft 15 is connected to the output end of the second motor 12; and the second motor 12 drives the mounting housing 1 to rotate relative to the base 7. The base 7 is provided with a concave step 17 that matches the protruding ring portion 16 for rotation. A limiting notch 18 is formed in a position of the protruding ring portion 16 to limit the rotation range, and a convex point 19 that matches the limiting notch 18 is formed in a position of the concave step 17.

The above embodiment specifically provides an implementable structure of the rotating device 6, the rotating device 6 is composed of a second motor 12, a bearing 13, a fixing shroud 14, a limiting shaft 15, and other components. A lower end of the mounting housing 1 is provided with the protruding ring portion 16, a circular concave step 17 is arranged in a position corresponding to the base 7, such that the protruding ring portion 16 is embedded in the concave step 17, the structure is not exposed, and a product volume is reduced. In order to achieve a connection between the mounting housing 1 and the base 7, the fixing shroud 14 is arranged inside the base 7, and screws pass through the fixing shroud 14, the base 7, and the mounting housing 1 in sequence and are connected to studs therein. The limiting shaft 15 is fixedly installed inside the base 7, and the output end of the second motor 12 is fixed on the limiting shaft 15. The bearing 13 is sleeved onto the protruding ring portion 16 and placed on the base 7.

During rotation, the output end of the second motor 12 is fixed on the limiting shaft 15. Therefore, the output end of the second motor 12 does not rotate, but the second motor 12 rotates instead, the second motor 12 is fixed inside the mounting housing 1, thereby driving the mounting housing 1 to rotate, and expanding the airflow range. Further, in order to limit the rotation range, a limiting notch 18 is formed on the protruding ring portion 16, the limiting notch 18 restricts the rotation range of the fan body 5, and a convex point 19 is formed in a position of the concave step 17 to provide blocking. When the mounting housing 1 rotates during driving, the limiting notch 18 rotates relative to the convex point 19; and after the rotation reaches an end of stroke thereof, the convex point 19 abuts against the limiting notch 18, and the second motor 12 reverses to achieve reciprocating rotation.

Specifically, the multifunctional outdoor fan further includes a charging interface 20, and the charging interface 20 is arranged on the base 7. Optionally, a battery 21 can be arranged inside the base 7, and is charged and powered via the charging interface 20, or the multifunctional outdoor fan can be directly connected to a power source for power supply.

Figure 14:
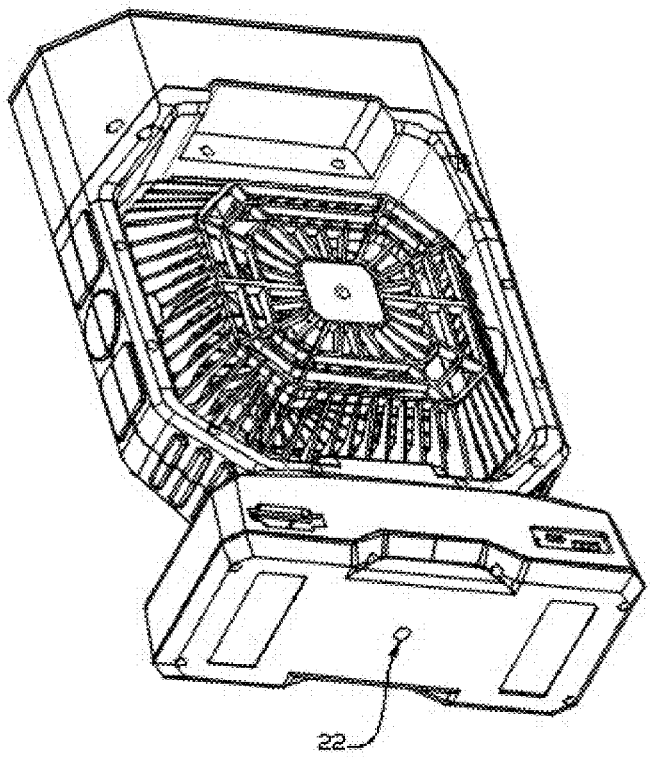
FIG. 14 is another structural schematic diagram according to the present disclosure.

As shown in FIG. 14, the multifunctional outdoor fan further includes a threaded opening 22, and the threaded opening 22 is arranged at a bottom of the base 7. Through the threaded opening 22, the multifunctional outdoor fan in the present disclosure can be used in conjunction with a tripod with threads, enabling the fan to be combined with external components; and the threaded opening 22 facilitates easy connection and height adjustment, making the fan adaptable to special usage scenarios.

The above description is not intended to limit the technical scope of the present disclosure. Any modifications, equivalent changes, or alterations made based on the technical essence of the present disclosure still fall within the scope of the technical solutions of the present disclosure.

What is claimed is:

1. A multifunctional outdoor fan, comprising:

a mounting housing, wherein a hollow installation area is formed in a middle of the mounting housing, a water tank, which is arranged on an upper part of the mounting housing, one or more atomization units, that are arranged inside the water tank, wherein the atomization units are exposed on the mounting housing, and water in the water tank is atomized and discharged by the atomization units, wherein the atomization units are ultrasonic atomizers;

a fan body, wherein the fan body is arranged in the installation area, at least one part of the fan body is hinged to a side wall of the installation area, and the fan body rotates relative to the installation area to adjust an airflow direction;

a rotating device, wherein the rotating device is arranged at a lower part of the mounting housing, and the rotating device is configured for driving the mounting housing to rotate; and a base, wherein the base is connected to the rotating device, and the base comprises a control panel for controlling an operating state of the multifunctional outdoor fan;

wherein the rotating device comprises a second motor, a bearing, a fixing shroud, and a limiting shaft;

the lower part of the mounting housing is provided with an outwardly protruding ring portion, the second motor is installed at the lower part of the mounting housing, and an output end of the second motor extends along a center of the protruding ring portion; the bearing is sleeved onto the protruding ring portion; the fixing shroud is installed inside the base, and the fixing shroud connects the base to the mounting housing through screws; the limiting shaft is fixedly arranged inside the base, and the limiting shaft is connected to the output end of the second motor; and the second motor drives the mounting housing to rotate relative to the base.

2. The multifunctional outdoor fan according to claim 1, wherein the fan body comprises a fan housing, a first motor arranged inside the fan housing, and a fan blade arranged on the first motor.

3. The multifunctional outdoor fan according to claim 1, wherein two sides of the fan body are hinged to side walls of the installation area, respectively.

4. The multifunctional outdoor fan according to claim 1, wherein the base is provided with a concave step that matches the protruding ring portion for rotation.

5. The multifunctional outdoor fan according to claim 4, wherein a limiting notch is formed in a position of the protruding ring portion to limit a rotation range, and a convex point that matches the limiting notch is formed in a position of the concave step.

6. The multifunctional outdoor fan according to claim 1, further comprising a threaded opening, wherein the threaded opening is arranged at a bottom of the base.

* * * * *